US005887579A

United States Patent [19]

Eriksson et al.

[11] Patent Number: 5,887,579

[45] Date of Patent: Mar. 30, 1999

[54] SAW AND SAW BLADE

[75] Inventors: Thomas Eriksson, Sundborn, Sweden; Gottfried Benz, Schaan, Liechtenstein; Harald Lang, Göfis, Austria; Willy Schönenberger, Weite, Switzerland

[73] Assignee: Hilti Aktiengesellschaft, Schaan, Liechtenstein

[21] Appl. No.: 783,772

[22] Filed: Jan. 15, 1997

[30] Foreign Application Priority Data

Jan. 17, 1996 [DE] Germany ..... 196 01 522.7

[51] Int. Cl.[6] ..... B28D 1/04

[52] U.S. Cl. ..... 125/14; 125/13.01; 125/15; 125/363; 125/342

[58] Field of Search ..... 125/14, 13.01, 125/15; 451/363, 342, 509, 510; 299/34.3; 85/666, 676, 618.41

[56] References Cited

U.S. PATENT DOCUMENTS

| | | | |
|---|---|---|---|
| 3,623,281 | 11/1971 | Moffat | 451/509 |
| 3,683,567 | 8/1972 | Ali | 451/509 |
| 4,683,683 | 8/1987 | Block | 451/509 |
| 4,869,227 | 9/1989 | Schuldei | 125/13.01 |
| 5,015,518 | 5/1991 | Sasaki et al. . | |
| 5,702,275 | 1/1998 | Preis et al. | 451/342 |
| 5,733,183 | 3/1998 | Schierling et al. | 451/342 |

FOREIGN PATENT DOCUMENTS

| | | |
|---|---|---|
| 2123856 | 9/1972 | France . |
| 3322595 | 2/1984 | Germany . |
| 9319915 | 10/1993 | WIPO . |

*Primary Examiner*—Robert A. Rose
*Assistant Examiner*—George Nguyen
*Attorney, Agent, or Firm*—Anderson, Kill & Olick, P.C.

[57] ABSTRACT

A wall saw includes a saw head which is displaceable longitudinally on a running rail and has a swivelable saw arm and a saw blade with cutting elements which is detachably fastened to the saw arm. The saw blade is rotatable by means of a drive unit which is mounted on the saw arm and which communicates with a drive arrangement. The saw blade is fastened to the saw arm via a coupling formed of two flange halves (11,17) which slide one inside the other and which can be connected with one another in a detachable manner, one flange half (11) being fastened to the flat side of the saw blade facing the saw arm and the second flange half (17) being arranged at the saw arm.

10 Claims, 3 Drawing Sheets

SAW AND SAW BLADE

BACKGROUND OF THE INVENTION

The invention is directed to a wall saw, in particular a wall saw for making flush cuts in concrete and the like substrates, in accordance with the preamble of patent claim 1. The invention is also directed to a saw blade for use in combination with a wall saw of the type mentioned above in accordance with the preamble of patent claim 8.

Wall saw systems are arrangements for cutting through walls of reinforced or unreinforced concrete with the aid of rotating saw blades provided with cutting segments and are described, for example, in brochure Nos. W 1881 594 10-d, 1994 and W 1838 993 10-d, 1993, published by the Hilti Aktiengesellschaft. They are used in building construction above, at or below ground level in, building demolition and renovation. For example, in demolition work for redevelopment projects, building modifications, or erection of add-on structures, it may be necessary to cut through or demolish existing concrete walls or to cut out areas of the concrete walls. In many applications, cuts can be made in areas of the concrete walls where there is adequate distance from an adjacent wall, ceiling or floor; on the other hand, flush cutting is required especially when making cuts for add-on structures or when cutting out door openings and the like. This means, for instance, that the cut must be made flush with an adjacent, vertically extending wall or, in the case of cutting out door openings, that the cuts must run flush with the floor and with the ceiling.

Conventional fastening arrangements which fix the saw blade to the saw head or saw arm cannot be used for flush cut applications of this kind because such arrangements are composed of elements that are arranged on both flat sides of the saw blade so as to clamp the saw blade between them and connect it with a drive unit mounted at the saw head. The fastening elements project over the flat sides of the saw blade and thus render flush cutting impossible. Flush flanges, as they are called, which are fixedly connected with the drive unit at the saw head or saw arm were developed for this reason. The saw blade is fixedly connected with the flush flange with the aid of countersink screws which are inserted through bore holes in the saw blade from the side located opposite to the flange and screwed into the flange. The heads of the screws terminate flush with the flat side of the saw blade. In these known flush flanges, no fastening elements project over the free flat side of the saw blade and cutting can accordingly be carried out flush with an adjacent wall, floor or ceiling.

When using wall saws and especially in flush cutting applications, care must be taken not to work with the largest saw blade diameter right from the start irrespective of the required or desired depth of cut. This is principally because saw blades with very large diameters of up to 1600 mm, for instance, can be deformed axially during operation, particularly under axial loading. This can cause vibrations or oscillations in the saw blade during operation and impair the true or circular running of the saw blade. Also, in flush cutting applications only one side of the saw blade is guided by the flush cut flange at the start of the cutting process. Therefore, the problem of oscillations in the saw blade can be even more pronounced in flush cutting applications. Therefore, when using wall saws a saw blade with a smaller starting diameter of 600 mm or 700 mm, for example, is always mounted to begin with for producing a preliminary cut. Subsequently, the saw blade is exchanged for a saw blade of greater diameter one or more times in gradations of 200 mm to 300 mm in order to produce a cut of the required depth. The saw blades with greater diameters are guided on both sides in the cut which has already been made and can thus no longer be deformed axially.

In the known fastening arrangements and flush cut flanges, the exchanging of saw blades is relatively time-consuming and difficult to manage, since the saw blade must be completely separated from the fastening arrangements. Flush cut applications have the additional problem that the fastening screws can only be reached from the flat side of the saw blade which faces the adjacent wall, floor or ceiling. For this reason, it is often necessary to lift the saw head from the track or running rail along which it is longitudinally displaceable and to tilt it in order to loosen the fastening screws, of which there are six, for example. After lifting off the saw blade from the flush cut flange connected with the saw head or saw arm, the next largest size saw blade must be lifted up and placed on the flush cut flange. The saw blade can only be secured to the flush cut flange again by the fastening screws after bringing the bore holes in the saw blade in alignment with the bore holes in the flush cut flange. The saw head with the saw blade secured thereto must then be attached to the running rail again.

It is relatively cumbersome and time-consuming to change the saw blades. In addition, it should not be forgotten that a saw head weighs about 30 kg or more and the saw blades weigh up to 70 kg. Therefore, in order to lift the saw head from the running rail and replace it on the running rail, the user must lift and adjust a weight of 100 kg. It should be taken into consideration that this must also be carried out under very cramped conditions in flush cutting applications. The saw blade is heavy and—especially with large diameters—very bulky and difficult to handle and can only be lifted with difficulty. Therefore, with known fastening arrangements for the saw blades and especially in known flush cutting flanges, changing saw blades also always requires a relatively great physical effort on the part of the user.

Therefore, it is an object of the present invention to improve a wall saw in such a way that the saw blade can be changed simply and quickly. It should be possible, even under cramped conditions such as occur particularly in flush cutting applications, to change the saw blade without needing to lift it from the running rail and tilt it. In general, the user should not have to lift the saw blade in order to change it. The saw blade should also be prepared in such a way that the saw blade can be lifted more easily than was previously possible should it ever be necessary to do so, e.g., in order to remove an exchanged saw blade from the work area.

SUMMARY OF THE INVENTION

This object is met in a wall saw and in a saw blade as they are defined in the patent claims. The wall saw comprises a saw head which is displaceable longitudinally on a running rail and has a swivelable saw arm and a saw blade with cutting elements which is detachably fastened to the saw arm and is rotatable by means of a drive unit which is mounted on the saw arm and communicates with a drive arrangement. According to the invention, the saw blade is fastened to the saw arm via a coupling comprising two flange halves which slide one inside the other and which can be connected with one another in a detachable manner, one flange half being fastened to the flat side of the saw blade facing the saw arm and the second flange half being arranged at the saw arm.

The configuration of the coupling with two flange halves in accordance with the invention substantially facilitates the changing of the saw blade. The saw blade need no longer be detached from the flange half. It is only necessary to undo the connection between the two flange halves to allow the saw blade to be removed. Then, the saw arm need only be restored, wherein one flange half slides out of the other flange half. The first flange half remains connected with the changed saw blade. The detached saw blade can be rolled out of the cut, for example. A saw blade with a larger diameter is then rolled into the cut which has already been made and the first flange half which is already connected therewith is turned toward the second flange half, The first flange half need only be aligned such that the two flange halves can slide one inside the other by the automatic adjustment of the saw arm. The two flange halves which have been slid one inside the other need then only be connected. A very important advantage of the construction, according to the invention, of the coupling between the saw head or saw arm and the saw blade consists in that all adjustments can be effected from the side of the saw head that is freely accessible also in flush cutting applications. In vertical cutting and flush cutting in the floor area, the steps required for lifting the saw blade are essentially limited to the alignment of the first flange half with the second flange half. In addition, when changing a saw blade, the alignment of the flange halves is carried out only after the new saw blade has been rolled into the cut which has already been made. Therefore, alignment is relatively easy because the saw blade is supported in the already existing cut and is prevented from falling out.

A driving spindle is provided at the drive unit for torque transmission, the second flange half being mounted rotatably thereon. In this way, the torque is transmitted directly to the saw blade via the flange halves. In order to fix the flange half at the driving spindle, a central mating piece is inserted through a central bore hole of the flange half and screwed onto the driving spindle. The flange half is thus centered and fixed and can be removed again or changed very quickly if necessary.

In an advantageous embodiment of the invention, the first flange half which is connected with the saw blade is constructed as a female flange and has a roughly V-shaped recess opening toward the circumference of the first flange half. The roughly V-shaped recess serves to receive and center a corresponding roughly V-shaped projection which projects from the side of the second flange half facing the saw blade, this second flange half forming the male part. The advantageous construction of the flange halves enables the two flange halves to slide one inside the other automatically by adjusting the saw arm. Owing to the approximately V-shaped construction of the recess at the female flange half which opens out in a widening funnel-shaped manner and the corresponding V-shaped construction of the projection at the male flange half, the two flange halves can still be reliably slid together even when alignment is not exact, since the narrowest region of the projection is guided into the widest part of the recess in the area of the opening at the start of the assembling process. Thus, as a result of the selected geometry, an automatic self-alignment of the two flange halves is effected.

In an advantageous manner, the inner width of the recess increases along its depth and the width of the projection decreases in a corresponding manner along its height in the direction of the end face of the second flange half such that the two flange halves fit together snugly. The recess in the first flange half is accordingly relief-cut or undercut along its depth, while the projection is provided with correspondingly sloping side walls. In this way, the projection slides into the undercut recess so as to fit snugly. The two flange halves are accordingly automatically secured axially when assembled and also have no axial play.

Once they have been secured axially, the flange halves need only be secured so as to be prevented from sliding apart radially. To this end, retaining screws are advantageously provided in an approximately radial arrangement at the circumference of the first flange half and can be screwed into corresponding radial bore holes provided with internal threads at the circumference of the second flange half. The retaining elements are practically not subjected to any shearing stresses during operation owing to the radial arrangement and need only withstand radial forces.

The conscientious user will ascertain that the flange halves are secured radially before putting the wall saw into operation. In order to assist in this purpose, the flange halves are outfitted in an advantageous construction variant with means for locking against rotation which prevent the saw blade from rotating when the assembled flange halves have not been secured radially. In this way, the wall saw can only be put into operation when the flange halves are secured radially.

In a very simple and effective embodiment variant, the means for locking against rotation comprise a ring which is arranged at the circumference of the second flange half and which can be slipped over the first flange half, provided the retaining screws are screwed in flush with the surface, and fixed in a detachable manner. At its side remote of the saw blade, the ring has at least one projecting cam. When the two flange halves are not secured radially, this cam cooperates with means which are rigidly arranged at the saw head or saw arm, e.g., a saw blade guard, to prevent rotation of the saw blade. When the ring is slipped over the first flange half, it forms an additional radial locking of the two flange halves which are slid together. Even if the radial retaining screws should fail, the ring will still prevent the two flange halves from sliding apart radially.

In accordance with the general inventive idea, the invention also provides a saw blade to be used with a wall saw. This saw blade is connected, at its side facing the saw head, with a flange half constructed as a female part having an approximately V-shaped recess opening toward the circumference of the flange half. The width of the recess increases along its depth.

Although the flange half can be produced integral with the saw blade, it is advantageous when the female flange half is detachably connected with the saw blade. To this end, a plurality of screws are provided, for example, which can be inserted from the flat side of the saw blade remote of the female flange half, through bore holes in the saw blade, these bore holes preferably being arranged equidistantly from one another, and screwed into bore holes in the female flange half so as to be flush with the surface of the saw blade. In this way, it is also possible for existing saw blades with prepared bore holes to be retrofitted with a female flange half constructed in accordance with the invention so that they can be used with a wall saw having a male flange half arranged at its saw head or saw arm.

Another advantage of outfitting a saw blade with a female flange half constructed according to the invention consists in that a carrying member can be detachably connected with the saw blade, this carrying member comprising at least one carrying handle which is connected with a flange half whose outer contour corresponds to the recess at the first flange half. The flange half is roughly V-shaped and decreases in width along the height of the flange half corresponding to the width increase in the recess at the first flange half such that the two flange halves are axially fixed in the assembled state. The saw blade and carrying member which are provided in accordance with the general inventive idea are outfitted with a coupling comprising two flange halves according to the invention. In this way, the carrying member can be coupled to the saw blade in a very simple manner in order to facilitate the lifting of the saw blade. When carrying the saw blade, the flange halves are held together by the weight of the saw blade. When the saw blade is set down, the carrying member can be removed again in a simple manner by pulling the flange half out of the recess of the flange half connected with the saw blade.

In the following, the invention will be described more fully with reference to an embodiment example which is illustrated schematically in various scales in the drawings:

DETAILED DESCRIPTION OF THE INVENTION

Figure 1:
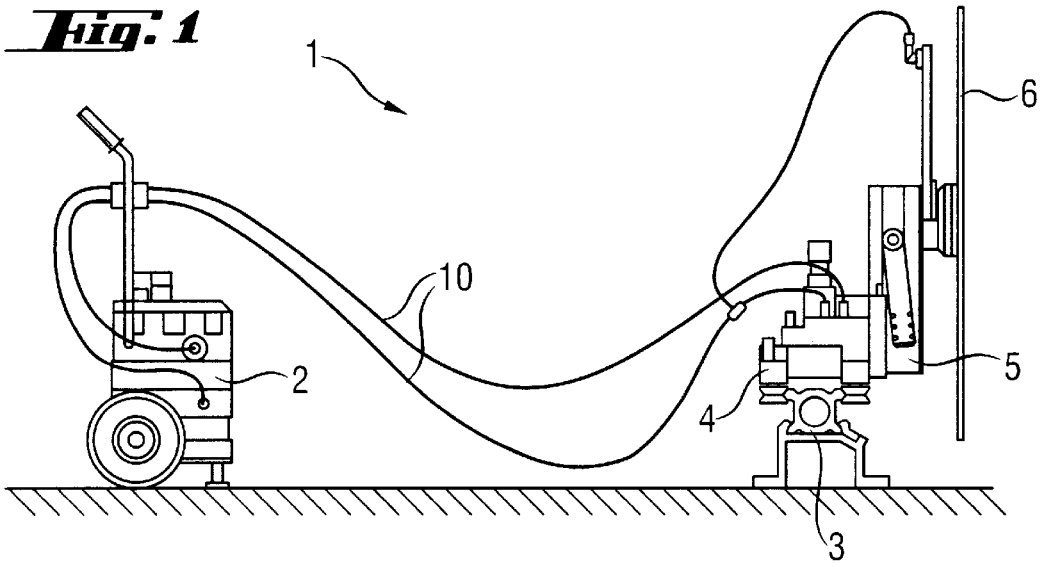
FIG. 1 is a general view of a construction variant of a wall saw system.

In FIG. 1, a wall saw system of the generic type is designated in its entirety by 1. It includes a drive arrangement 2 which conventionally operates hydraulically and is connected via hydraulic lines 10 with a saw head 4 of a wall saw. The saw head 4 is longitudinally displaceable on a running rail 3 and has a vertically swivelable saw arm 5, a saw blade 6 outfitted with cutting elements being fastened to this saw arm 5 so as to be rotatable.

Figure 2:
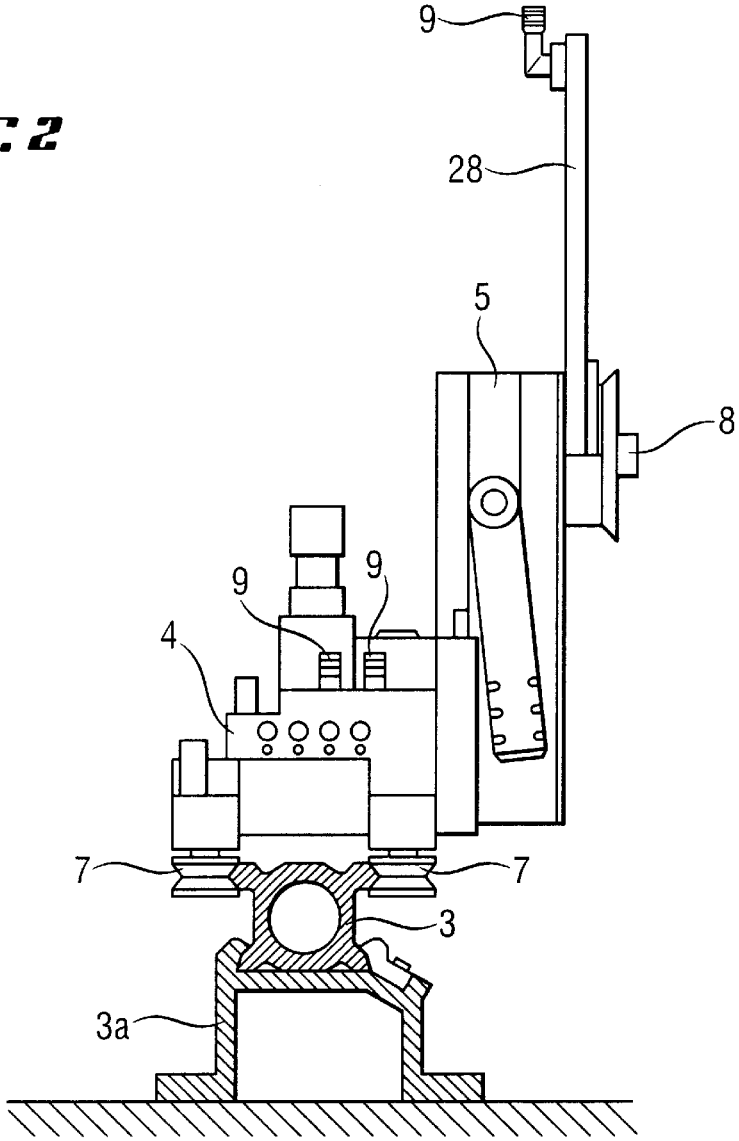
FIG. 2 shows a saw head arranged on a running rail without a saw blade.

FIG. 2 shows a saw head 4 with a swivelable saw arm 5. For better clarity, the saw blade is not illustrated in FIG. 2. The running rail 3 supporting the saw head 4 is constructed as a section rail or profile rail and is supported above the floor by rail feet 3*a*. The saw head 4 has running rollers 7 on its placement side to facilitate its capacity to move in a longitudinal direction on the running rail 3. The vertically swivelable saw arm 5 which is connected with the saw head 4 carries a drive unit 8 by means of which the saw blade, not shown, can rotate. Normally, the drive unit 8 comprises a driving spindle which is connected with coupling elements for the saw blade. Hydraulic connections 9 are provided at the saw head 4 and at the saw arm 5. The drive unit 8 is connected via these hydraulic connections 9 with the drive arrangement 2 to set the driving spindle in rotation and enable the swiveling of the saw arm. FIG. 2 also shows a protective holder 28 for the saw blade having a connection, not shown in more detail, for supplying rinsing water. The arrangement as described thus far corresponds to the wall saws commonly known from the prior art which are also sold by the Hilti Aktiengesellschaft.

Figure 3:
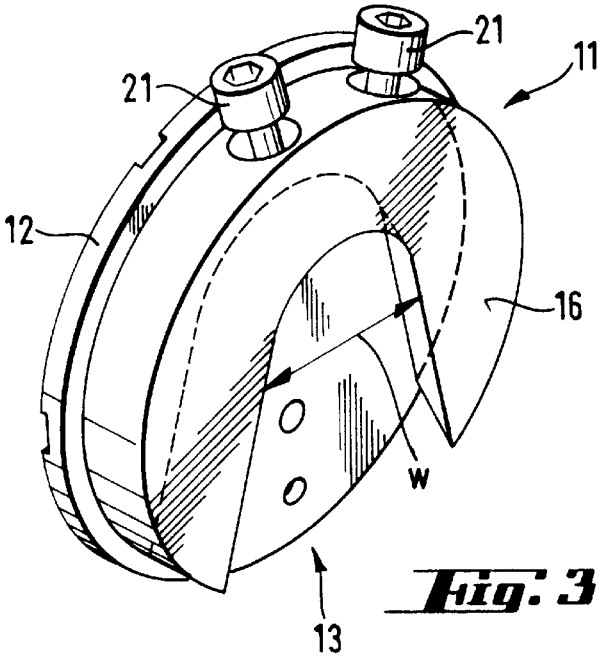
FIG. 3 is a perspective view of a female flange half according to the invention.
Figure 4:
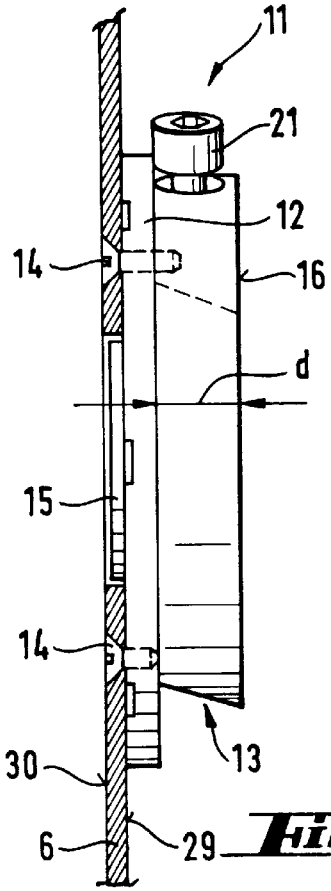
FIG. 4 is a side view of the female flange half, illustrated in FIG. 3, showing the saw blade.

FIGS. 3 to 7 show the coupling elements of the wall saw modified according to the invention. The coupling elements comprise two flange halves 11 and 17 which are connected with one another so as to slide one inside the other and so as to be detachable. The first flange half 11 shown in FIGS. 3 and 4 is constructed as a female flange half and is connected with the saw blade 6. The female flange half 11 has a screw plate 12 provided with bore holes which are preferably arranged equidistant from one another and contacts a flat side 29 of the saw blade 6 in the assembled state. For assembly, fastening screws 14 are inserted through bore holes in the saw blade 6 proceeding from the second flat side 30 of the saw blade 6 and are screwed into the bore holes in the screw plate 12 of the female flange half 11 that are provided with an internal thread. When tightened, the heads of the fastening screws 14 close flush with the second flat side 30 of the saw blade 6. There are six fastening screws 14, for example. A centrically arranged, circular projection 15 which projects into the central bore hole in the saw blade 6 when assembled can be arranged on the side of the screw plate 12 contacting the saw blade 6 to assist in mounting the female flange half 11 on the saw blade 6.

The female flange half has a depth d of about 5 mm to approximately 20 mm. In the end face 16 of the female flange half 11 located opposite to the screw plate 12, a roughly V-shaped recess 13 is provided which opens toward the circumference of the flange half 11. The inner width w of the recess increases toward the screw plate 12 in the depth d of the recess 13. Accordingly, the recess 13 is relief-cut or undercut. Retaining screws 21 are arranged radially at the circumference of the female flange half 11 and project into the recess 13. Their function will be discussed hereinafter.

Figure 5:
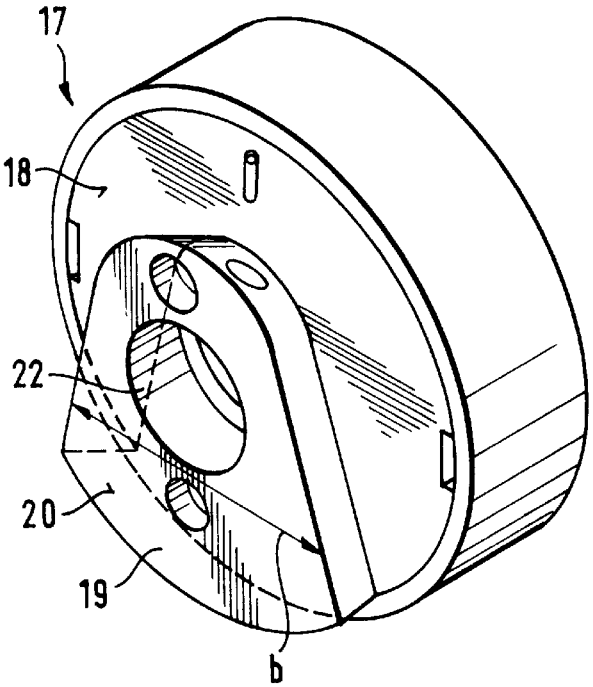
FIG. 5 is a perspective view of a male flange half.
Figure 6:
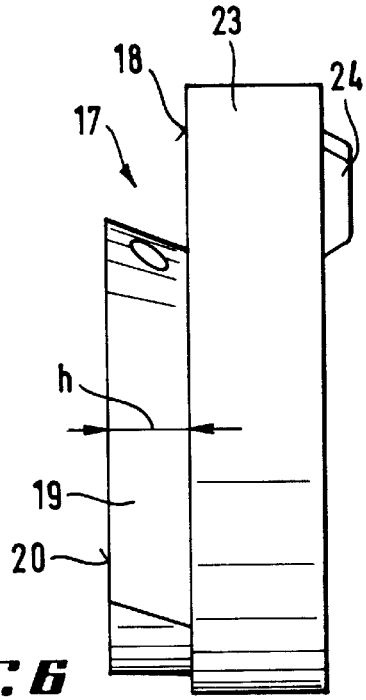
FIG. 6 is a side view of the male flange half illustrated in FIG. 5.

FIGS. 5 and 6 show a second flange half 17 of the coupling elements according to the invention. The second flange half 17 forms the mate or counterpiece of the female flange half connected with the saw blade and is constructed as a male part. The second flange half 17 is somewhat lozenge-shaped and has a projection 19 which projects from the side 18 facing the female flange half. The projection 19 is shaped so as to correspond to the recess at the female flange half and accordingly has an approximately V-shaped configuration. The width b of the projection 19 decreases over its height h proceeding from its greatest width at its contact face 20 to the same extent that the inner width of the recess at the female flange half increases along its depth. The depth of the recess in the female flange half and the height of the projection at the second flange half correspond to one another. In this way, the two flange halves are secured axially when slid together and also have no axial play.

The second flange half 17 is fixedly connected with the drive unit at the saw head or at the saw arm. For this purpose, it has a centric bore hole 22 for receiving the driving spindle of the drive unit. The fixing to the driving spindle is effected, for example, by means of a complementary piece or counterpiece which is screwed onto the driving spindle proceeding from the side of the contact face 20 and in so doing the second flange half is fixed. In addition, a flange can be provided at the driving spindle, the second flange half being screwed onto the latter. In this regard, FIG. 5 shows bore holes at the contact face which serve to receive the fastening screws.

Figure 7:
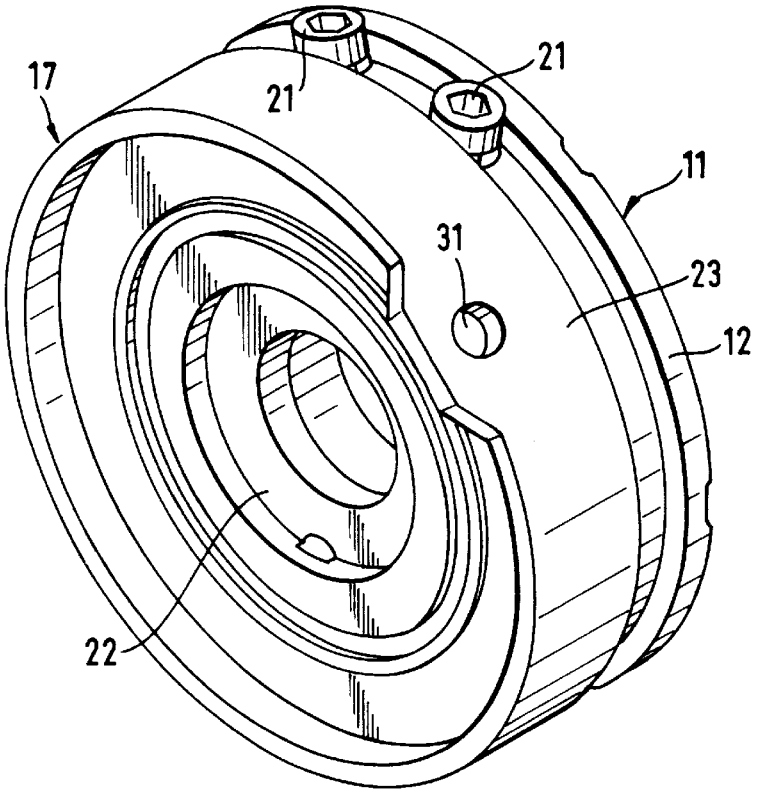
FIG. 7 is a perspective view of the two flange halves illustrated in FIGS. 3 and 5, which flange halves are slid together but not secured radially.

FIG. 7 shows the first female flange half 11 and the second male flange half 17 in the assembled state. The illustration shows the rear side of the second flange half 17 which is connected with the driving spindle. The radial retaining screws 21 at the circumference of the female flange half 11 are not yet screwed into the corresponding bore holes in the projection of the second flange half 17, which bore holes are provided with an internal thread. An axially displaceable ring 23, already indicated in FIGS. 5 and 6, which surrounds the second flange half 17 contacts the radial retaining screws 21 which project over the circumference of the female flange half. At its side remote of the female flange half 11 and the saw blade, the ring 23 has a projecting cam 24. In the assembled state, this projecting cam 24 cooperates with the protective holder of the saw blade, designated by 28 in FIG. 2, and prevents rotation of the saw blade until the two assembled flange halves 11, 17 are also fixed radially by tightening the radial retaining screws 21. Only at that point can the ring 23 be displaced along the circumference of the female flange half 11 until reaching the screw plate 12. The ring 23 is locked in this position, for example, by a pin-shaped locking bar, not shown, which is pretensioned in a springing manner and is arranged in the second flange half 17 and engages in the bore hole 31 in the ring 23. The projecting cam 24 is accordingly disengaged from the saw blade guard and the saw blade can be rotated. The ring 23 provides additional radial locking for the two flange halves 11, 17 in that it prevents them from sliding apart radially.

In order to disconnect the coupling, the spring-loaded pin-shaped locking bar must first be disengaged from the bore hole 31 in the ring 23. This is effected, for example, by pressing in the locking bar, wherein the ring 23 is pulled back from the circumference of the female flange half 11 at the same time. The two flange halves 11, 17 are accordingly released again and can slide apart after loosening the screws 21.

Figure 8:
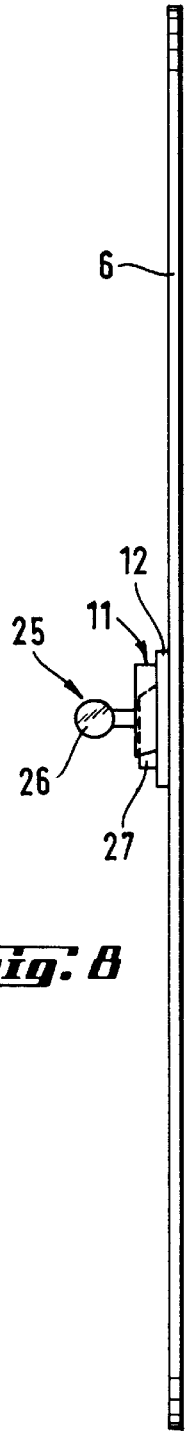
FIG. 8 is a side view of a saw blade with a female flange half and attached carrying member.
Figure 9:
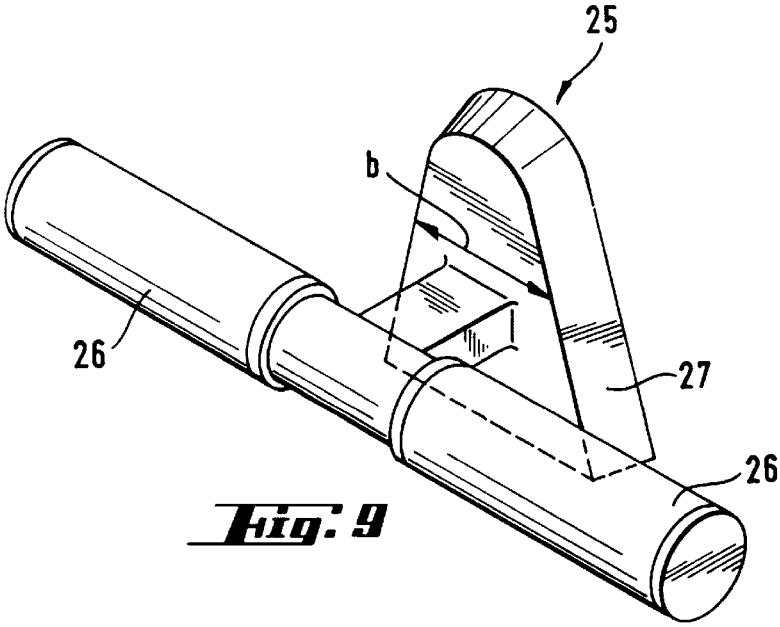
FIG. 9 is a perspective view of the carrying member for a saw blade.

In accordance with the general inventive idea, by providing the saw blade 6 with a female flange half 11 according to the invention, it is also possible to connect a carrying member 25 as indicated in FIG. 8. FIG. 9 shows an embodiment example of the carrying member 25. It has two carrying handles 26 which are provided at a horizontal pipe or bar. The horizontal bar is connected with a flange half 27 which is constructed as a counterpiece to the recess in the female flange half 11. The flange half 27 has a roughly V-shaped outer contour. The width b of the flange half 27 decreases along its height to the same extent that the inner width of the recess in the female flange half increases along its depth. In this way, the two flange halves 11, 27 are axially secured in the assembled state. In this respect, the exactness of the fit in the axial direction or the agreement between the height of the flange half 27 and the depth of the recess at the female flange half 11 is not overly important, since a slight tilting of the saw blade has no effect when lifting.

We claim:

1. Wall saw comprising a saw head (4) which is displaceable longitudinally on a running rail (3) and has a swivelable saw arm (5) and a saw blade (6) with cutting elements which is detachably fastened to the saw arm (5) and is rotatable by means of a drive unit (8) which is mounted on the saw arm (5) and communicates with a drive arrangement (2), characterized in that the saw blade (6) is fastened to the saw arm (5) via a coupling comprising two flange halves (11, 17) which slide one inside the other and which can be connected with a another in a detachable manner, one flange half (11) being fastened to a flat side (29) of the saw blade (6) facing the saw arm (5) and a second flange half (17) being arranged at the saw arm (5).

2. Arrangement according to claim 1, characterized in that the drive unit (8) includes a driving spindle, the second flange half (17) being mounted rotatably on the latter.

3. Arrangement according to claim 1 or 2, characterized in that the first flange half (11) which is connected with the saw blade (6) is constructed as a female flange and has a roughly V-shaped recess (13) which opens toward the circumference of the first flange half (11) and serves to receive and center a corresponding roughly V-shaped projection (19) which projects from the side (18) of the second flange half (17) facing the saw blade (6), the second flange half (17) forming a male part.

4. Arrangement according to claim 3, characterized in that the inner width (w) of the recess (13) increases along its depth (d) and the width (b) of the projection (19) decreases in a corresponding manner along its height (h) in the direction of the end face (18) of the second flange half (17) such that the two flange halves (11, 17) fit together substantially exactly in the assembled state, wherein the depth (d) of the recess (13) and the height (h) of the projection (19) substantially correspond to one another.

5. Arrangement according to claim 4, characterized in that retaining screws (21) are provided in an approximately radial arrangement at the circumference of the first flange half (11) and project into the recess (13) and can be screwed into corresponding radial bore holes provided with internal threads at the projection (19) of the second flange half.

6. Arrangement according to claim 5, characterized in that the flange halves (11, 17) are outfitted with means for locking against rotation preventing the saw blade (6) from rotating when the assembled flange halves (11, 17) have not been secured radially.

7. Arrangement according to claim 6, characterized in that the means for locking against rotation comprise an axially displaceable ring (23) which is arranged at the circumference of the second flange half (17) and which can be slipped over the first flange half (11), provided the retaining screws (21) are screwed in flush with the surface, and fixed in a detachable manner, the ring (23) having at its side remote of the saw blade (6) at least one projecting cam (24) which, when the two flange halves (11, 17) are not secured radially, cooperates with means which are rigidly arranged at the saw head (4) or saw arm (5), e.g., a protective holder (28) for the saw blade, to prevent rotation of the saw blade (6).

8. Saw blade to be used with a wall saw in accordance with claim 4, charaterized in that the saw blade is connected, at the side (29) facing the saw head (4), with a flange half (11) constructed as a female part having the approximately V-shaped recess (13) opening toward the circumference of the flange half (11), an inner width (w) of the recess (13) increasing along a depth (d) thereof.

9. Saw blade according to claim 8, characterized in that the female flange half (11) is detachably connected with the saw blade (6) and is held, by a plurality of screws (14) which can be inserted from an opposite side (30) of the saw blade (6) through evenly spaced radial bore holes arranged in the saw blade (6) and screwed into bore holes in the female flange half (11) so as to be flush with the surface of the saw blade (6).

10. Saw blade according to claim 8, characterized in that a carrying member (25) is detachably connectible with the saw blade (6), the carrying member (25) comprising at least one carrying handle (26) connected with a flange half (27) whose outer contour corresponds to the recess (13) at the female flange half (11) and has a roughly V-shaped configuration which decreases in width (b) along its height corresponding to the width increase in the recess (13) such that an two flange halves (11, 27) are axially fixed in the assembled state.

* * * * *